US011471905B1

(12) United States Patent
Arminak

(10) Patent No.: US 11,471,905 B1
(45) Date of Patent: Oct. 18, 2022

(54) ALL PLASTIC AIRLESS PUMP DISPENSER

(71) Applicant: APackaging Group LLC, Azusa, CA (US)

(72) Inventor: Armin Arminak, Pasadena, CA (US)

(73) Assignee: APACKAGING GROUP LLC, Azusa, CA (US)

( * ) Notice: Subject to any disclaimer, the term of this patent is extended or adjusted under 35 U.S.C. 154(b) by 0 days.

(21) Appl. No.: 17/542,296

(22) Filed: Dec. 3, 2021

Related U.S. Application Data

(60) Provisional application No. 63/247,730, filed on Sep. 23, 2021.

(51) Int. Cl.
*B05B 11/00* (2006.01)

(52) U.S. Cl.
CPC ..... *B05B 11/3074* (2013.01); *B05B 11/3001* (2013.01)

(58) Field of Classification Search
CPC ..... B05B 11/307; B05B 11/3074; B05B 11/3001
USPC ..... 222/251, 153.09, 321.7, 321.9
See application file for complete search history.

(56) References Cited

U.S. PATENT DOCUMENTS

| | | | | |
|---|---|---|---|---|
| 3,138,301 | A | 6/1964 | Ward | |
| 3,282,472 | A | 11/1966 | Eberhard | |
| 3,726,442 | A | 4/1973 | Davidson et al. | |
| 4,036,438 | A | 7/1977 | Soderlind et al. | |
| 4,146,155 | A | 3/1979 | Kutik et al. | |
| 4,155,487 | A | 5/1979 | Blake | |
| 4,174,056 | A | 11/1979 | Loeffler | |
| 4,191,313 | A | 3/1980 | Blake et al. | |
| 4,201,317 | A | 5/1980 | Aleff | |
| 4,241,853 | A | 12/1980 | Pauls et al. | |
| 4,371,097 | A | 2/1983 | O'Neil | |
| 4,527,741 | A | 7/1985 | Gameau | |
| 4,591,077 | A | 5/1986 | Corsette | |
| 5,363,993 | A * | 11/1994 | Mascitelli | B05B 11/3077 222/321.9 |
| 5,673,824 | A | 10/1997 | Evans | |
| 5,711,459 | A | 1/1998 | Glynn | |
| 5,924,603 | A | 7/1999 | Santagiuliana | |
| 6,290,145 | B1 | 9/2001 | Mizushima et al. | |
| 7,246,723 | B2 | 7/2007 | Santagiuliana | |
| 7,328,856 | B2 | 2/2008 | Bloc et al. | |
| 7,578,417 | B2 | 8/2009 | Son | |
| 7,654,418 | B2 | 2/2010 | Law et al. | |
| 7,942,291 | B2 | 5/2011 | Foster | |
| D655,200 | S | 3/2012 | Gross et al. | |
| 9,937,509 | B2 | 4/2018 | DeJong | |
| 9,962,723 | B2 | 5/2018 | Baughman | |
| 10,335,816 | B1 * | 7/2019 | Arminak | F16K 15/044 |
| 10,434,532 | B2 * | 10/2019 | Ophardt | B05B 11/3028 |

(Continued)

FOREIGN PATENT DOCUMENTS

| | | |
|---|---|---|
| CA | 2797766 C | 6/2015 |
| DK | 1754542 T3 | 1/2011 |

(Continued)

*Primary Examiner* — Lien M Ngo
(74) *Attorney, Agent, or Firm* — Cislo & Thomas. LLP

(57) ABSTRACT

A manually operated, airless pump dispenser featuring all plastic construction, including a dome-shaped elastic polymer spring, is presented. The airless pump dispenser is suitable for dispensing liquids, crémes, foams and gels. Used pumps do not require disassembly to be recycled.

13 Claims, 10 Drawing Sheets

(56) References Cited

U.S. PATENT DOCUMENTS

| | | | | |
|---|---|---|---|---|
| 10,794,445 | B2 | 10/2020 | Deman et al. | |
| 11,236,794 | B2 * | 2/2022 | Deman | F16F 1/3732 |
| 2003/0116588 | A1 * | 6/2003 | Santagiuliana | B05B 11/3023 222/321.9 |
| 2004/0055457 | A1 * | 3/2004 | Masuda | B05B 11/3053 92/13 |
| 2005/0115990 | A1 | 6/2005 | Kang | |
| 2006/0255071 | A1 * | 11/2006 | Behar | B05B 11/3076 222/256 |
| 2008/0000933 | A1 | 1/2008 | Marelli | |
| 2011/0017779 | A1 | 1/2011 | Rossignol | |
| 2012/0267399 | A1 * | 10/2012 | Moretti | B05B 11/3069 222/321.2 |
| 2016/0318053 | A1 * | 11/2016 | De Jong | F04B 15/02 |
| 2016/0332181 | A1 | 11/2016 | DeMan | |
| 2017/0265691 | A1 | 9/2017 | Ophardt et al. | |
| 2017/0291185 | A1 * | 10/2017 | Kim | A45D 34/02 |
| 2017/0326567 | A1 | 11/2017 | Santagiuliana | |
| 2018/0171998 | A1 * | 6/2018 | Sun | B05B 11/3023 |
| 2020/0290793 | A1 | 9/2020 | Driskell | |
| 2021/0000306 | A1 | 1/2021 | Arminak | |

FOREIGN PATENT DOCUMENTS

| | | | |
|---|---|---|---|
| EP | 0691161 | A1 | 1/1996 |
| EP | 1389491 | A1 | 2/2004 |
| EP | 1398491 | A1 * | 2/2004 |
| EP | 1938903 | A2 * | 7/2008 |
| EP | 1982929 | B1 | 4/2013 |
| JP | H07101480 | A | 4/1995 |
| JP | 2001287762 | A | 10/2001 |
| JP | 2014166624 | A | 12/2021 |
| KR | 20190034506 | A | 4/2019 |
| WO | WO2021001811 | A1 | 4/2019 |

* cited by examiner

ALL PLASTIC AIRLESS PUMP DISPENSER

CROSS-REFERENCES TO RELATED APPLICATION

This application claims the benefit of U.S. Provisional Application Ser. No. 63/247,730, filed Sep. 23, 2021 and entitled "All Plastic Airless Dispenser," which is incorporated herein by this reference.

BACKGROUND OF THE INVENTION

Field of the Invention

The present invention relates to hand held and hand operated dispensing pumps suitable for dispensing liquids, crémes, foams, gels or other flowable materials.

Background Art

Hand operated, airless dispensing pumps are known in the personal care and other industries for dispensing fluid products such as liquids, crémes, gels and foams. Airless pump dispensers have the advantage of not exposing the product to contact with open air and thereby are effective in preventing product spoilage. The majority of airless dispensing pumps presently available are made from plastic but include at least a metal compression spring to return the pump actuator to its starting position after being depressed. Typically, hand operated, airless dispensing pumps are pre-installed on a fluid filled container prior to sale and are disposed of along with the container when the contents of the container are depleted. The pumps are not typically intended to be reused. Although airless dispensing pumps using metal return springs operate effectively, and are of relatively low cost to make, they have certain drawbacks. In particular, they require disassembly prior to recycling to remove the metal springs and the springs are prone to rust which, over time, may contaminate the product to be dispensed.

As discussed above, there is room for improvement in the art of hand operated, airless pump dispenser design. What is needed in the art is a hand operated, airless pump dispenser made of all plastic components. Such a design would make airless pump dispensers more cost effective to recycle and therefore more desirable as a source of recyclable plastic.

SUMMARY OF THE INVENTION

The airless pump dispenser of the present invention overcomes the disadvantages typically associated with airless pump dispensers by providing a pump design fabricated entirely from all plastic components which renders the design more cost effective to manufacture and well-suited for recycling. By eliminating the metal compression spring of prior art designs, the new airless pump dispenser design also eliminates potential product contamination with rust which is known to form over time in prior art dispensers using metallic springs.

The airless pump dispenser of the present invention includes in principle part, an actuator, an elastic return spring, a stem, a pump piston, a pump housing, an inlet check valve, a chaplet and a pump housing retainer, a container and a moving piston. The actuator includes a flow passage having a liquid inlet at a lower end and a dispensing outlet at an upper end, which is configured as a nozzle. The actuator also includes a vent which serves to vent to atmosphere an area enclosed by the elastic return spring. The actuator is configured to engage with an upper end of the stem.

The stem has upper and lower ends with a central flow passage therebetween. At the lower end, the central flow passage terminates in a transverse flow passage having two liquid inlets, where the liquid inlets are selectively opened and closed by the pump piston sliding over a portion of the stem. The pump piston in conjunction with the stem functions as an upper check valve. The stem is configured to engage with the actuator at its upper end and is configured to receive the pump piston over a portion of its lower end.

The pump housing is a generally hollow cylindrical body having an upper and a lower end with an interior volume or pump chamber therebetween. The upper end of the pump housing is open and the lower end has a liquid inlet with the lower check valve disposed above the liquid inlet. The pump housing is configured to interface with a container, which will typically be filled with a liquid to be dispensed, by means of a chaplet and a pump housing retainer.

The stem and the pump piston connected thereto are disposed within the pump chamber and reciprocate within the pump chamber via upstrokes and down strokes of the actuator. Disposed between the actuator and the chaplet is the elastic return spring. The elastic return spring serves to bias the actuator upwardly so that the actuator returns to its upwards most position after depression of the actuator.

The container of the airless pump dispenser is a generally hollow cylindrical tube having an open upper end, a closed lower end and an interior volume. Disposed within the container, initially, at the lower end, is a moving piston. Disposed at the lower end of the container and below the moving piston is a vent which vents the container to atmosphere. Due to suction generated during upstrokes of the actuator and the stem and pump piston connected thereto, the moving piston rises upwardly in the container as liquid in the container is dispensed. In the exemplary embodiment, the container includes a cap which prevents the actuator from being inadvertently depressed during shipping and when the pump dispenser is not in use.

The airless pump dispenser of the present invention functions as follows. The first full operating cycle of the airless pump dispenser primes the system. In a first step, the actuator is depressed. As the first down stroke begins, the lower check valve is closed preventing fluid from entering the pump chamber. Simultaneously, the upper check valve is opened, which corresponds to the piston sliding upwardly about the stem and uncovering the transverse flow passage. Air in the pump chamber is compressed on the down stroke and thus pressurized air flows out of the pump chamber and into the liquid inlets of the transverse flow passage, through the central flow passage of the stem into the flow passage of the actuator and exits out the dispensing outlet. As the nozzle is depressed, the elastic return spring is also compressed.

In a second step, upon the actuator being fully depressed and released, the first upstroke commences as the elastic return spring drives the actuator upwardly to its at-rest position. As the first upstroke begins, the pump piston slides downwardly about the stem and closes the liquid inlets of the transverse flow passage. Simultaneously, suction within the pump chamber causes the lower check valve to open allowing liquid from the container to enter and fill the pump chamber.

Each subsequent operating cycle of the airless pump dispenser causes fluid to be dispensed from dispenser outlet of the actuator. In particular, on the second and each subsequent down stroke of the actuator and the stem and pump piston connected thereto, as the stroke commences, the lower check valve closes and the pump piston slides upwardly about the stem, opening the liquid inlets of the transverse flow passage. As the down stroke continues, the liquid within the pump chamber is pressurized and thus flows through the liquid inlets of the transverse flow passage, through the flow passage of the stem and the flow passage of the actuator and exits from the dispensing outlet.

On the second and each subsequent upstroke of the actuator and the stem and pump piston connected thereto, as the upstroke commences, the pump piston slides downwardly about the stem, closing the liquid inlets of the transverse flow passage and the lower check valve opens allowing liquid to be drawn from the container and into the pump chamber. Thus, each operating cycle of the airless pump dispenser, after the first cycle, causes liquid to be dispensed from the dispenser outlet of the actuator.

As liquid in the container is dispensed, the movable piston moves upwardly in the container. In order for the movable piston to move upwardly, the volume of the container below the level of the movable piston must be vented to the atmosphere, which is accomplished by including at least one vent in the container at a position below the lowermost position of the movable piston, i.e. by placing the vent at or near the bottom of the container. At least one vent is also placed in the actuator to vent the volume enclosed by the elastic return spring to atmosphere, as otherwise spring performance on down strokes would be hindered.

The above and other advantages of the airless pump dispenser of the present invention will be described in more detail below.

DETAILED DESCRIPTION OF THE PREFERRED EMBODIMENTS

The present invention will now be described more fully hereinafter with reference to the accompanying drawings, in which preferred embodiments of the invention are shown. The invention may, however, be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Figure 2:
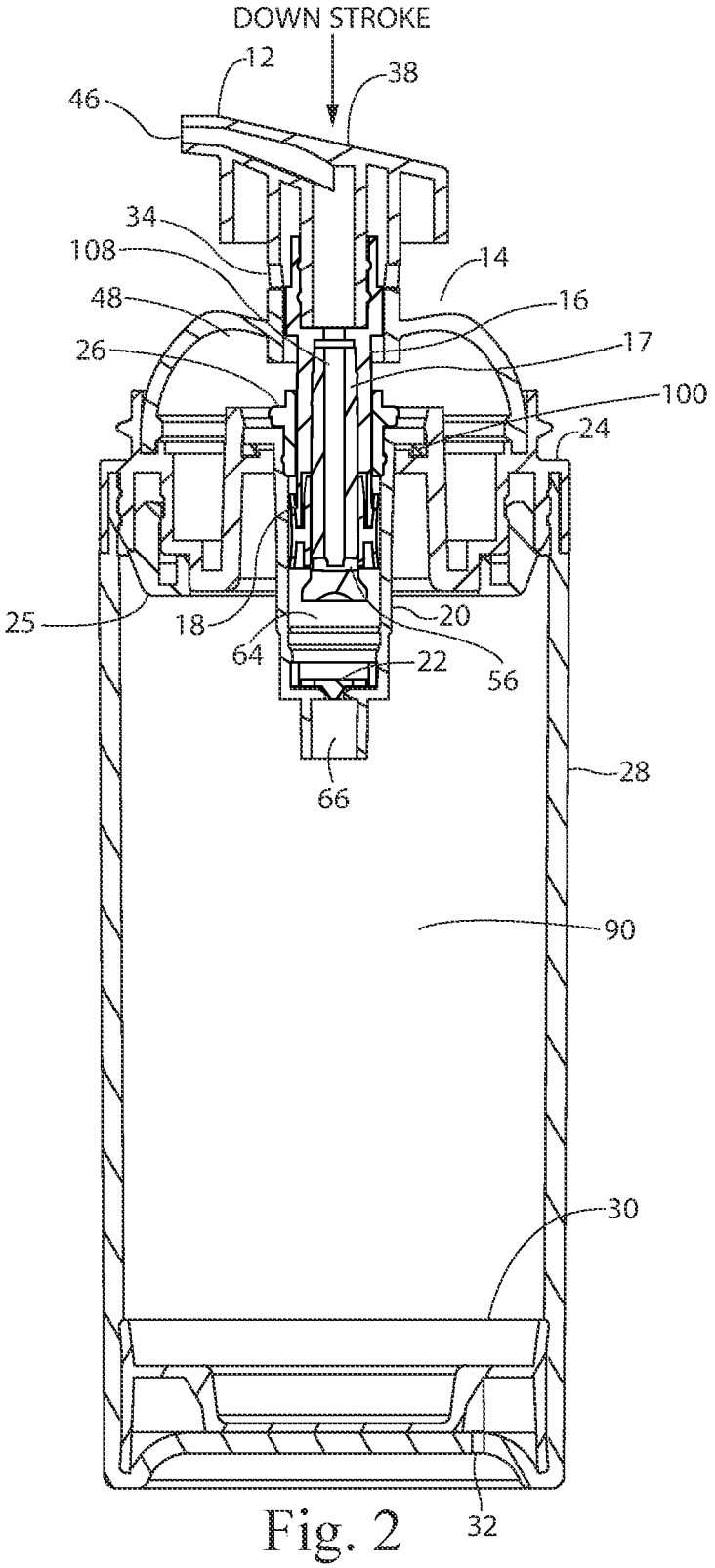
FIG. 2 is an exemplary cross-sectional view of the hand operated, airless dispensing pump of the present invention, showing the position of the pump components on a downstroke of the actuator.
Figure 3:
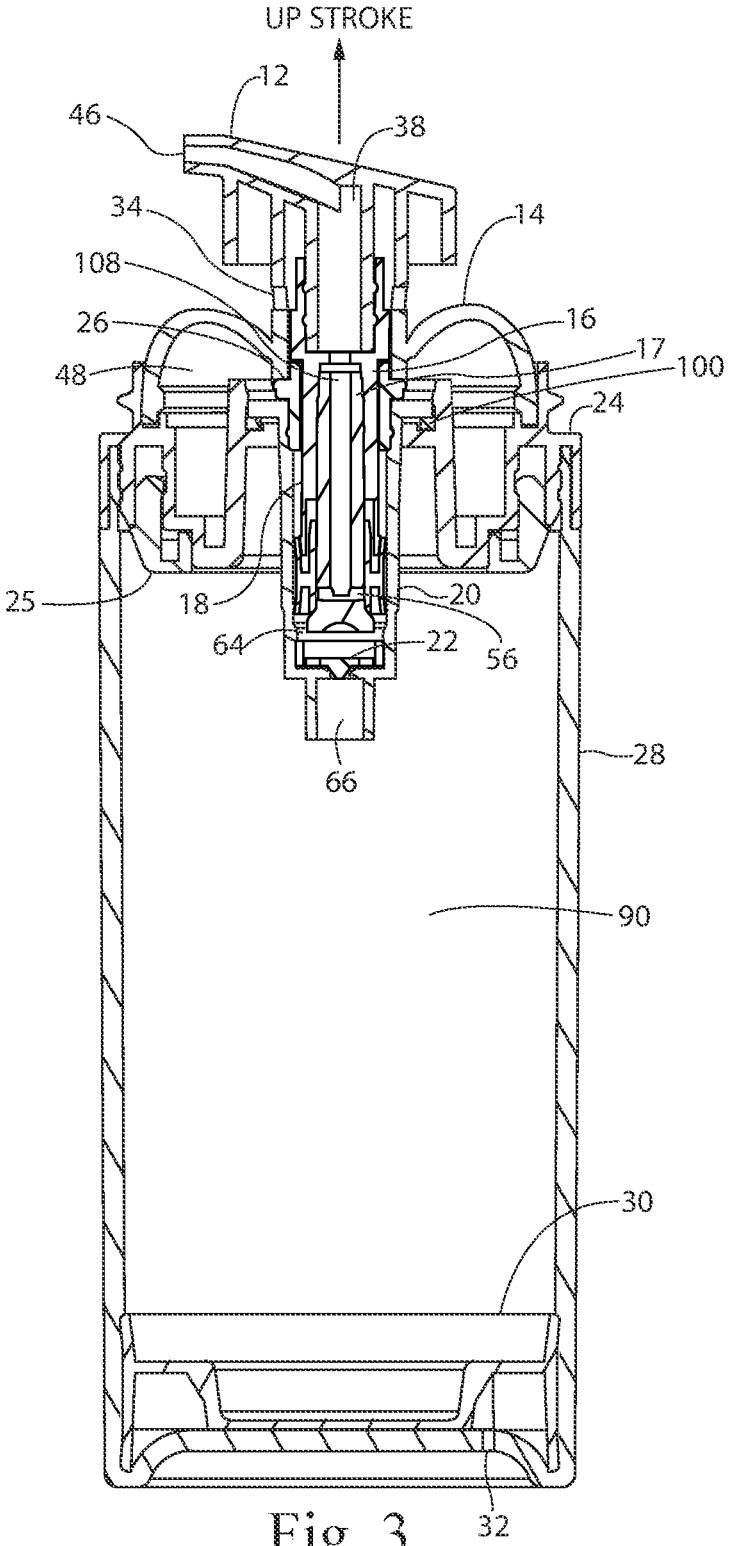
FIG. 3 is an exemplary cross-sectional view of the hand operated, airless dispensing pump of the present invention, showing the position of the pump components on an upstroke of the actuator.
Figure 4:
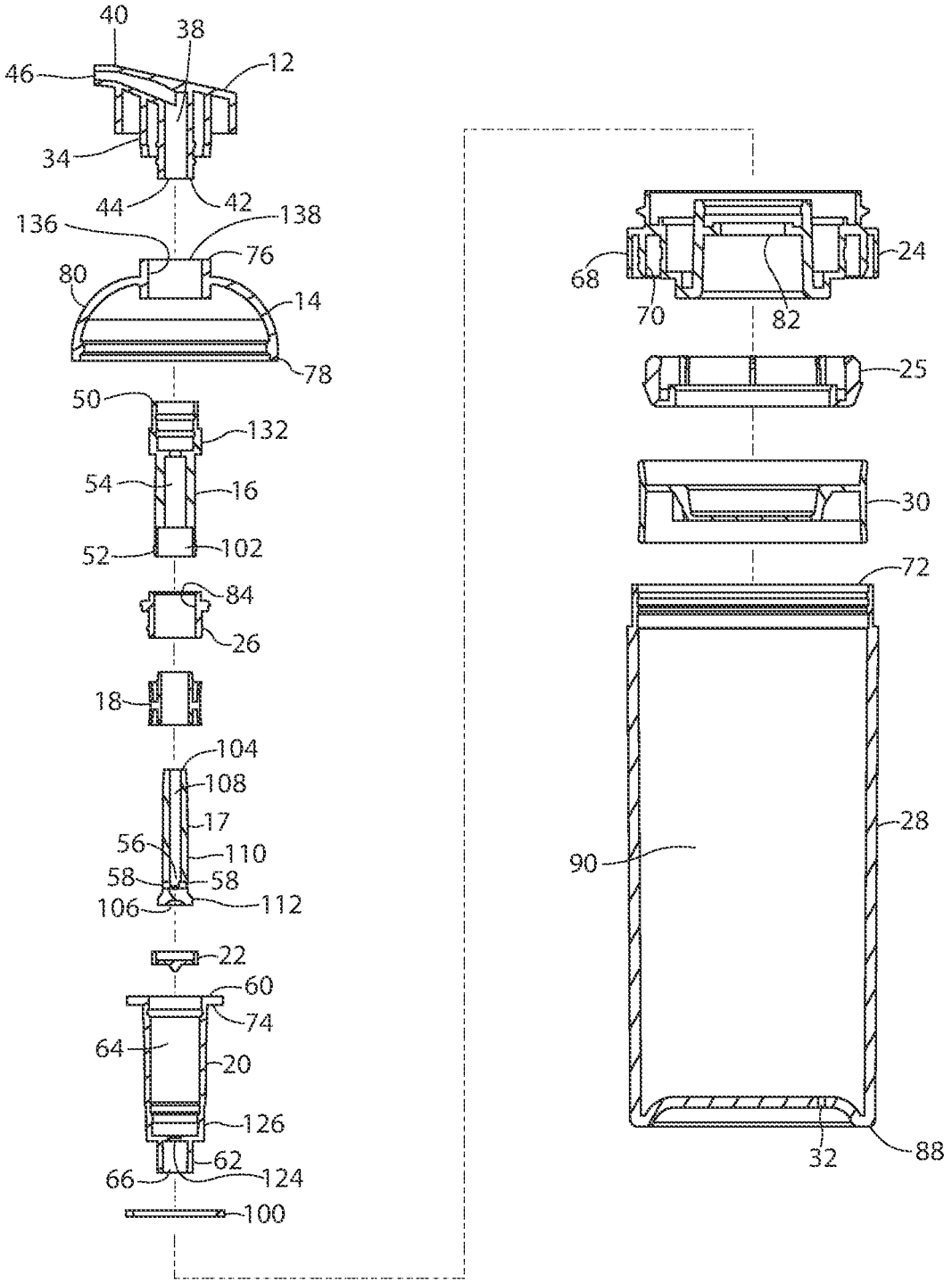
FIG. 4 is an exemplary exploded, cross-sectional view of the hand operated, airless dispensing pump of the present invention.

With reference to FIGS. 1-7, and particular reference to FIG. 4, the airless pump dispenser 10 of the present invention includes in principle part, an actuator 12, an elastic return spring 14, a stem 16, a sub-stem 17, a pump piston 18, a pump housing 20, an inlet check valve 22, a chaplet 24, a chaplet retainer 25, a stem retainer 26, a container 28 and a moving piston 30. The actuator 12 includes an upper end 40 and a lower end 42 having a flow passage 38 therebetween. The flow passage 38 has a liquid inlet 44 at the lower end 42 of the actuator 12 and a dispensing outlet 46 at an upper end 40 of the actuator 12, wherein the dispensing outlet 46 is configured as a nozzle. The actuator 12 also includes at least one vent 34 which serves to vent to atmosphere a volume 48 enclosed by the elastic return spring 14. The actuator 12 is configured to engage with an upper end 50 of the stem 16 via a snap or press fit.

The stem 16 has an upper end 50 and a lower rim surface 52 with a central passage 54 therebetween. The central passage 54 terminates in a cylindrical space 102. The sub-stem 17 includes an upper end 104 and a lower end 106, with a flow passage 108 therebetween and has cylindrical exterior 110. At the lower end 106 of the sub-stem 17, the flow passage 108 terminates in a transverse flow passage 56 having two liquid inlets 58, where the liquid inlets 58 are selectively opened and closed by the pump piston 18 sliding over a portion of the sub-stem 17.

Figure 5:
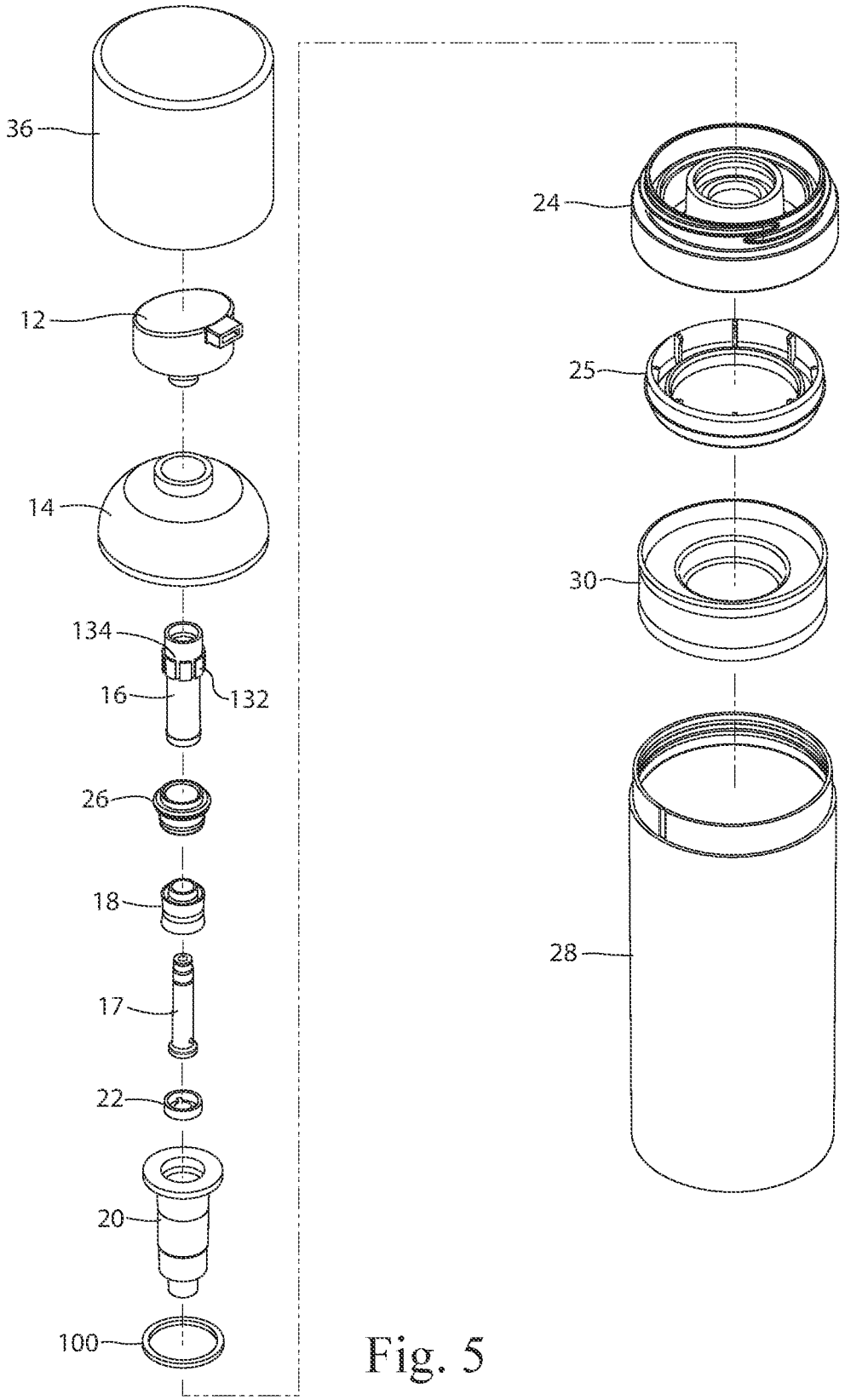
FIG. 5 is an exemplary exploded, perspective view of the hand operated, airless dispensing pump of the present invention.

With particular reference to FIG. 5, the stem 16 further includes a plurality of raised portions 132 spaced about the perimeter of the stem which form a plurality of vent passages 134 therebetween. The raised portions 132 of the stem 16 abut an interior cylindrical wall 136 of a neck portion 138 of the return spring 14. The plurality of vent passages 134 in the stem, in conjunction with the at least one vent 34 in the actuator 12, serve to vent a volume 48 enclosed by the dome-shaped, return spring 14 to atmosphere during downstrokes of the actuator 12. That is, at least one of the plurality of vent passages 134 is in fluid communication with the volume 48 enclosed by the return spring 14 at one end and, at another end, is in fluid (air) communication with the at least one vent 34 of the actuator 12.

The sub-stem 17 attaches to the stem 16 by means of a press fit between the central passage 54 of the stem 16 and a cylindrical exterior surface 110 of the sub-stem 17. Consequently, the stem 16 and sub-stem 17 reciprocate in the pump chamber 64 as a single unit. The pump piston 18 retained between the stem 16 and sub-stem 17 also reciprocates in the pump chamber 64 in conjunction with the stem 16 and sub-stem 17. The pump piston 18 is able to slide upwardly and downwardly for a limited range of motion about the sub-stem 17 during such reciprocating movement.

The pump piston 18 is positioned on the sub-stem 17 and is slidable over the sub-stem 17 through a limited range of motion defined by a sealing lip 112 of the sub-stem 17 and the lower rim surface 52 of the stem 16. The limited range of motion provided allows the pump piston 18 to slide upwardly on the sub-stem 17 on down-strokes of the actuator 12, a sufficient distance to partially uncover and allow fluid to enter the liquid inlets 58 of the transverse flow passage 56 of the sub-stem 17. Similarly, on down-strokes of the actuator 12 the pump piston 18 slides downwardly over the sub-stem 17 to seal against the sealing lip 112 of the sub-stem 17, thereby closing the liquid inlet inlets 58 and preventing fluid flow into the transverse flow passage 56.

The pump piston 18 in conjunction with the sub-stem 17 functions as an upper check valve 130 (see FIG. 1), i.e. the sliding action of the pump piston 18 opens and closes liquid inlets 58 of the sub-stem 17. The upper end 50 of the stem 16 is configured to engage with the lower end 42 of the actuator 12 via a snap or press fit.

The pump housing 20 is a generally hollow cylindrical body having an upper end 60 and a lower end 62 with an interior volume therebetween defining a pump chamber 64. The upper end 60 of the pump housing is open and the lower end 62 has a liquid inlet 66. The pump housing 20 includes the lower check valve 22 which is disposed above the liquid inlet 66. The lower check valve 22 controls the entrance of liquid into the pump chamber 64 during operation of the airless pump dispenser 10. More particularly, the lower check valve 22 opens during upstrokes of the actuator 12 and the stem 16 and sub-stem 17 and pump piston 18 connected thereto and closes during down strokes of the actuator 12 and the stem 16 and sub-stem 17 and pump piston 18 connected thereto. The pump housing 20 is configured to interface with a container 28, which will typically be filled with a liquid to be dispensed, by means of a chaplet 24 and a stem retainer 26.

Figure 1:
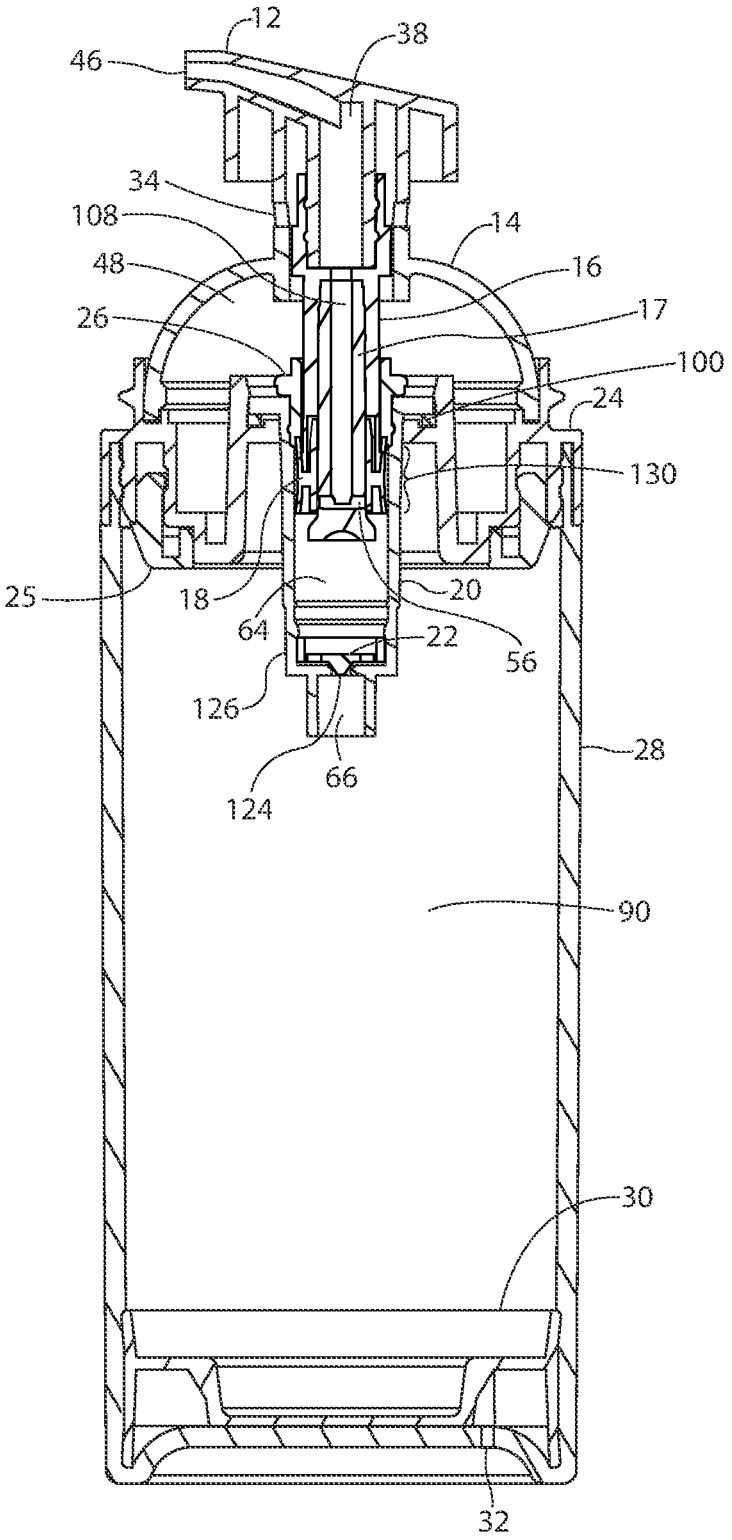
FIG. 1 is an exemplary cross-sectional view of the hand operated, airless dispensing pump of the present invention, showing the position of the pump components in their at-rest position.
Figure 8:
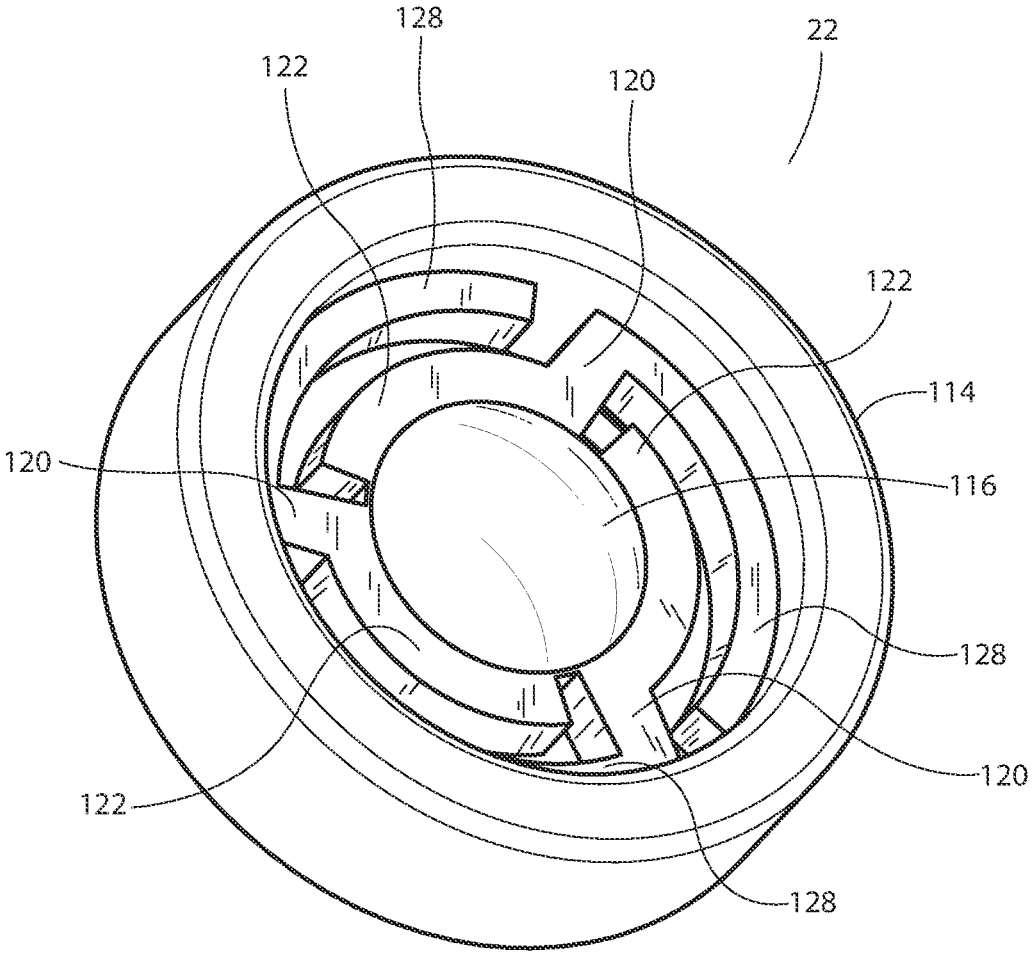
FIG. 8 is an exemplary cross-sectional, perspective view of the lower check valve of the hand operated, airless dispensing pump of FIG. 1.
Figure 9:
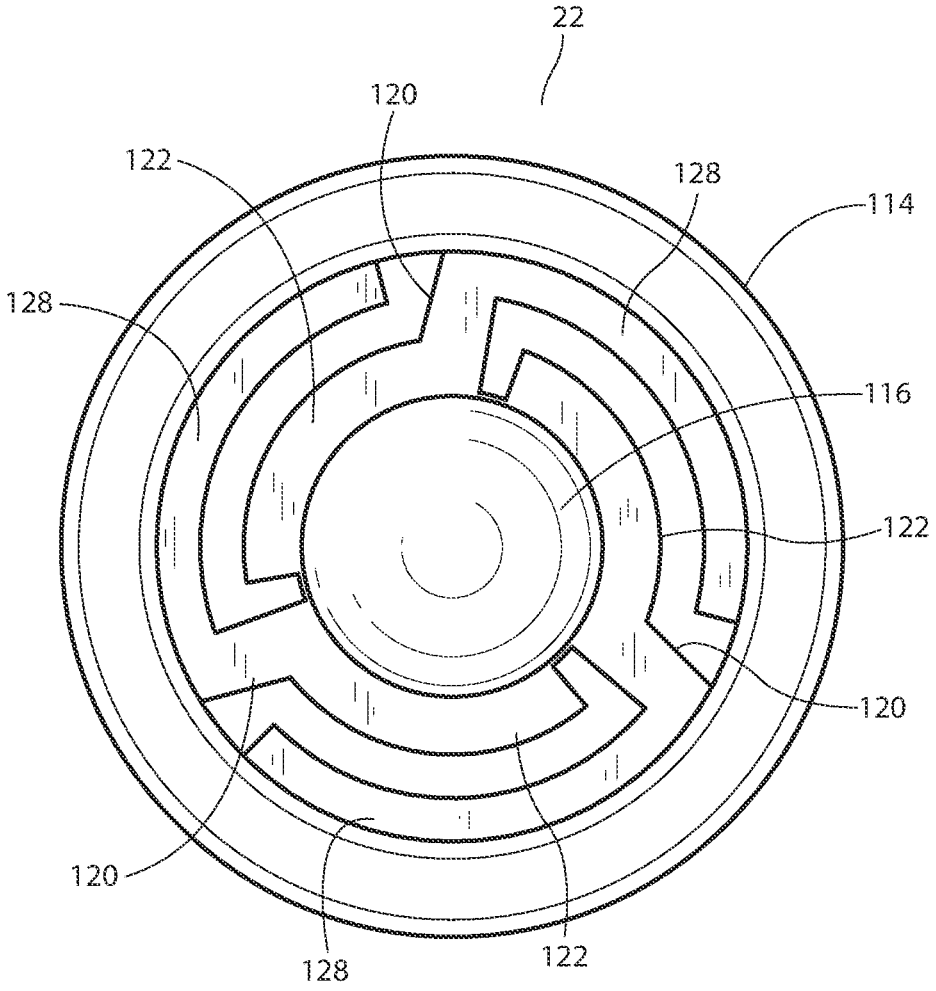
FIG. 9 is an exemplary top view of the lower check valve of the hand operated, airless dispensing pump of FIG. 8.
Figure 10:
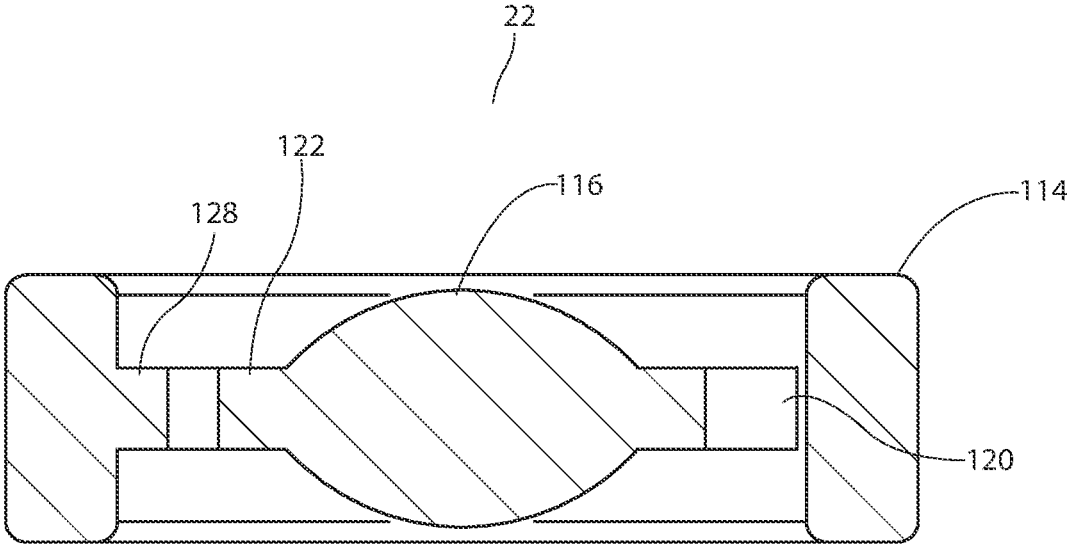
FIG. 10 is an exemplary cross-sectional view of the lower check valve of the hand operated, airless dispensing pump of FIG. 8.

With reference to FIGS. 1 and 4, and particular reference to FIGS. 8-10, the lower check valve 22 may be configured as a diaphragm style valve responsive to fluid or gas pressure. In the exemplary embodiment, the lower check valve 22 comprises a ring 114 and a dome-shaped sealing element 116, where the dome-shaped sealing element 116 is suspended within the ring 114 by means of a plurality of elastic suspension elements 120, which are spaced about the interior perimeter of the ring and exterior perimeter of the dome-shaped sealing element. The rigidity of the ring 114 is improved by the addition of a plurality of interior stiffening elements 128, which are semicircular in configuration. Similarly, the rigidity of the dome-shaped sealing element 116 is improved by the addition of a plurality of exterior stiffening elements 122.

In the exemplary embodiment, three elastic suspension elements 120, interior stiffening elements 128 and exterior stiffening elements 122 are equally spaced about the interior perimeter of the ring and exterior perimeter of the dome-shaped sealing element 116. These elements are configured such that each elastic suspension element 120 connects to both an interior stiffening element 128 and exterior stiffening element 122.

The lower check valve 22 is configured to seat within a lower cylindrical portion 126 of the pump housing 20, where the dome-shaped sealing element 116 abuts an inlet orifice 124 which is in fluid communication with liquid in the container 28. The lower check valve 22 is made from an elastic material and consequently, seals the inlet orifice 124 against liquid intrusion into the pump chamber 64 on down-strokes of the actuator 12 and stem 16 and pump piston 18 connected thereto. On upstrokes of the actuator 12 and stem 16 and pump piston 18 connected thereto, suction in the pump chamber 64 causes the dome-shaped sealing element 116 to lift off the inlet orifice 124 and thereby allows liquid from the container 28 to enter the pump chamber 64. One suitable elastic material for the lower check valve 22 is polyethylene. Other plastic and rubber materials are also suitable.

Alternatively, the lower check valve 22 may be a ball style check valve where a check ball 94 is responsive to changes in pressure within the pump chamber 64. That is the check ball 94 seals the inlet orifice 124 between the liquid inlet 66 and the pump chamber 64, on down strokes of the pump piston 18 thereby preventing either air or liquid in the pump chamber 64 from being expelled into the container 28. Similarly, on upstrokes of the pump piston 18, the check ball is drawn out of the inlet orifice 124 and thereby allows liquid to be drawn from the container 28 into the pump chamber 64.

The chaplet 24 is a component that functions to close out an open, upper end 72 of the container 28. The chaplet 24 includes an outer cylindrical retaining wall 68 and an inner cylindrical retaining wall 70. A portion of the upper end 72 of the container 28 is constrained within the outer cylindrical retaining wall 68 and the inner cylindrical retaining wall 70 of the chaplet 24 by means of a snap or press fit. The chaplet 24 also functions to suspend the pump housing 20 within the center of the container 28 and includes a circular opening 82 for this purpose. The chaplet 24 retains a flange 74 of the pump housing 20 by means of a snap or press fit. A gasket 100 resides between the flange 74 of the pump housing 20 and the circular opening 82 of the chaplet 24 and prevents leakage from the container at this interface. Attached to the chaplet 24 by means of a press fit is the chaplet retainer 25.

The stem 16, sub-stem 17 and the pump piston 18 connected thereto are disposed within the pump chamber 64 and reciprocate within the pump chamber 64 via upstrokes and down strokes of the actuator 12. The stem retainer 26 functions to interface the stem 16 with the pump housing 20 and acts essentially as a support bushing for the stem 16 within the pump housing 20. The stem retainer 26 engages with the pump housing 20 via a snap or press fit and includes a cylindrical bore 84 through which is disposed the stem 16 in a slip fit relationship.

Figure 7:
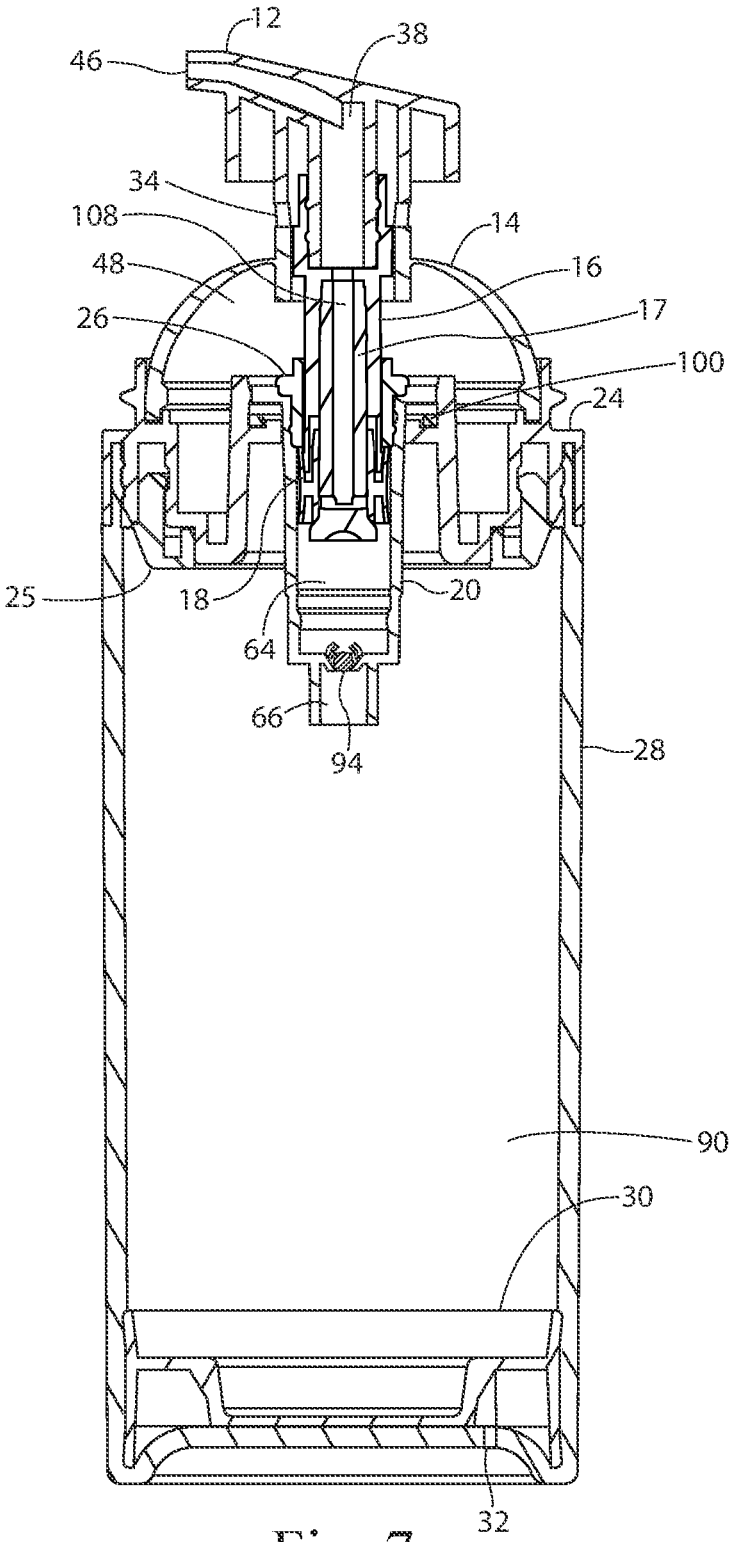
FIG. 7 is an exemplary cross-sectional view of the hand operated, airless dispensing pump of the present invention, showing an alternative, ball style embodiment of the lower check valve and an alternative embodiment of the return spring featuring a continuously tapering wall thickness.

Disposed between the actuator 12 and the chaplet 24 is the elastic return spring 14. The elastic return spring 14 serves to bias the actuator 12 upwardly so that the actuator 12 returns to its upward most position after being depressed. The elastic return spring 14 is generally dome shaped having an upper end 76 and a lower end 78 and a wall thickness 80. The wall thickness 80 may be uniform or, alternatively, may continuously taper from the lower end 78 to the upper end 76. FIG. 7 depicts the embodiment of the return spring 14 where the wall thickness 80 continuously tapers from the lower end 78 to the upper end 76.

Figure 6:
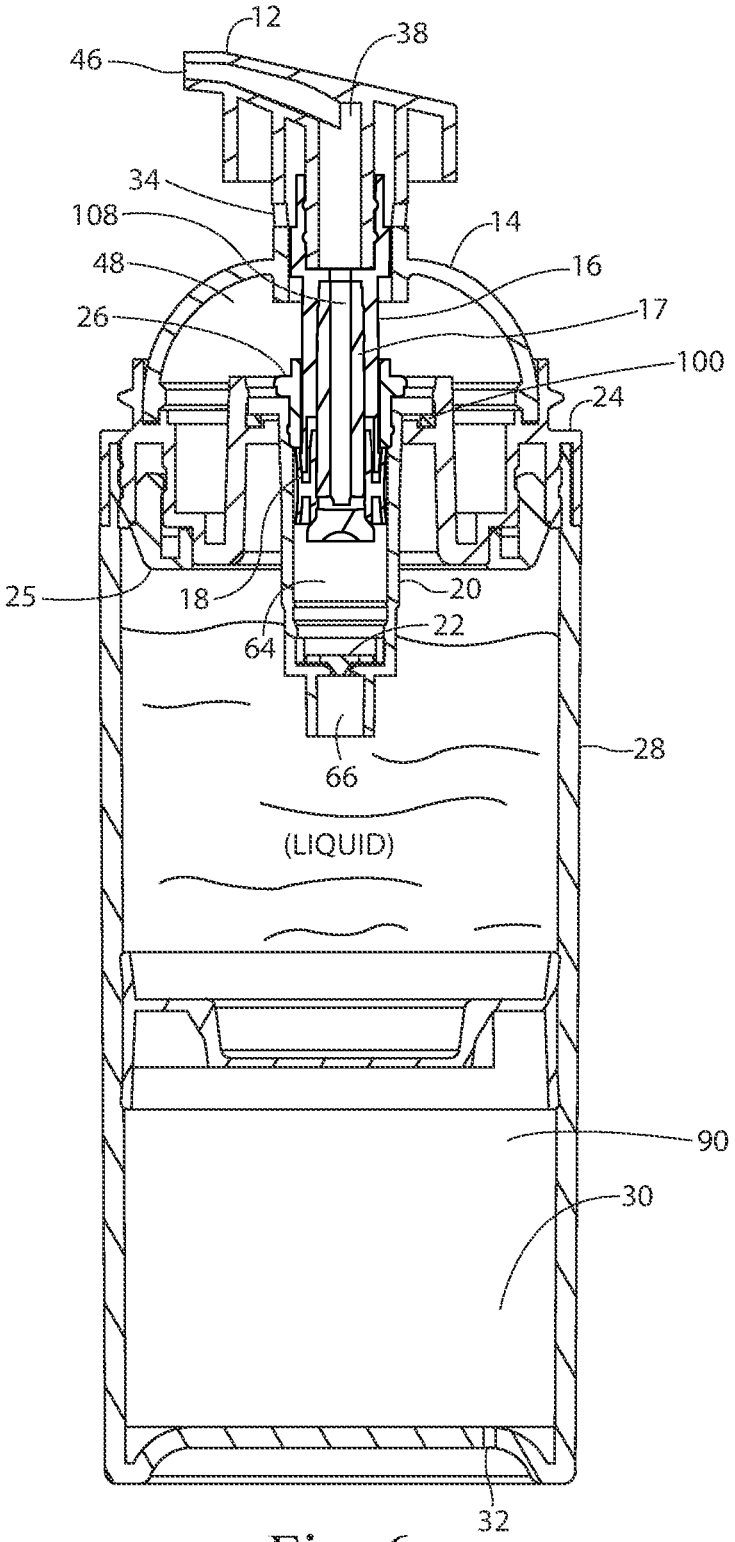
FIG. 6 is an exemplary cross-sectional view of the hand operated, airless dispensing pump of FIG. 1, showing the actuator in its at-rest position, with liquid partially dispensed from the container.

The container 28 of the airless pump dispenser 10 is a generally hollow cylindrical tube having an open, upper end 72, a closed lower end 88 and an interior volume 90. Disposed within the container, initially at the lower end, is the moving piston 30. Disposed at the lower end 88 of the container 28 and below the moving piston 30 is a vent 32 which vents the container 28 to atmosphere. Due to suction generated during upstrokes of the actuator 12 and the stem 16, sub-stem 17 and pump piston 18 connected thereto, the moving piston 30 rises upwardly in the container as liquid in the container is dispensed, as shown in FIG. 6. In the exemplary embodiment, the container includes a cap 36 which prevents the actuator 12 from being inadvertently depressed during shipping and when the airless pump dispenser 10 is not in use.

Operation of the Airless Pump Dispenser

The airless pump dispenser 10 of the present invention functions as follows. The first full operating cycle of the airless pump dispenser 10 primes the system. With reference to FIG. 2, in a first step, the actuator 12 is depressed initiating a down stroke. As the first down stroke begins, initial downwards movement of the pump piston 18 creates air pressure which causes the lower check valve 22 to close, thereby preventing fluid from entering the pump chamber 64. Simultaneously, the upper check valve 130 is opened, which corresponds to the pump piston 18 sliding upwardly about the sub-stem 17 for a short distance sufficient to and uncover the liquid inlets 58 in the transverse flow passage 56. As the down stroke continues, air in the pump chamber 64 continues to be compressed and thus flows out of the pump chamber 64 and into the liquid inlets 58 of the transverse flow passage 56. The air subsequently flows through the flow passage 108 of the sub-stem 17 and into the flow passage 38 of the actuator 12 and exits out the dispensing outlet 46. As the actuator 12 is depressed, the elastic return spring 14 is also compressed.

With reference to FIG. 3, in a second step, upon the actuator 12 being fully depressed and released, the first upstroke commences as the elastic return spring 14 drives the actuator 12 upwardly to its at-rest position. As the first upstroke begins, the pump piston 18 slides downwardly about the sub-stem 17 for a short distance sufficient to close the liquid inlets 58 of the transverse flow passage 56. Simultaneously, suction within the pump chamber 64 causes the lower check valve 22 to open allowing liquid from the container 28 to enter and fill the pump chamber 64 from the liquid inlet 66 of the pump housing 20, where the liquid inlet 66 is in fluid communication with the pump chamber 64 and the liquid in the container 28.

Each subsequent operating cycle of the airless pump dispenser 10 causes fluid to be dispensed from dispensing outlet 46 of the actuator. In particular, on the second and each subsequent down stroke of the actuator 12 and the stem 16, sub-stem 17 and pump piston 18 connected thereto, as the stroke commences, the lower check valve 22 closes and the pump piston 18 slides upwardly about the sub-stem 17 for a limited distance sufficient to open the liquid inlets 58 of the transverse flow passage 56. As the down stroke continues, the liquid within the pump chamber 64 is pressurized and thus flows through the liquid inlets 58 of the transverse flow passage, through the flow passage 108 of the sub-stem 17 and the flow passage 38 of the actuator 12 and exits from the dispensing outlet 46.

On the second and each subsequent upstroke of the actuator 12 and the stem 16, sub-stem 17 and pump piston 18 connected thereto, as the upstroke commences, the pump piston 18 slides downwardly about the stem 16 for a limited distance sufficient to close the liquid inlets 58 of the transverse flow passage 56 and the lower check valve 22 opens allowing liquid to be drawn from the container 28 through the liquid inlet 66 of the pump housing 20 and into the pump chamber 64. Thus, each operating cycle of the airless pump dispenser 10 after the first cycle causes liquid to be dispensed from the dispensing outlet 46 of the actuator 12.

As liquid in the container 28 is dispensed, the moving piston 30 moves upwardly in the container 28, in response to suction created during upstrokes of the pump piston 18. In order for the moving piston 30 to move upwardly, the interior volume 90 of the container 28 below the level of the moving piston 30 must be vented to the atmosphere, which is accomplished by including a vent 32 in the container 28 at a position below the lowermost position of the moving piston 30, i.e. by placing the vent 32 at or near the bottom of the container 28.

With particular reference to FIGS. 1 and 5, the volume 48 enclosed by the dome-shaped, return spring 14 is vented to atmosphere during downstrokes of the actuator 12. Venting is accomplished by means of the plurality of vent passages 134 formed in the stem 16. At least one of the plurality of vent passages 134 is in fluid (air) communication with the interior volume 48 enclosed by the return spring 14 at one end and at another end is in fluid (air) communication with the at least one vent 34 of the actuator 12. In the absence of venting, performance of the return spring 14 on down strokes of the actuator would be hindered.

While the present invention has been described with regards to particular embodiments, it is recognized that additional variations of the present invention may be devised without departing from the inventive concept.

What is claimed is:

1. A hand operated airless dispensing pump made from all plastic materials, for dispensing fluid from a container, comprising:

an actuator, a stem, a pump piston, a pump body, an upper check valve, a lower check valve, a return spring, a container and a moving piston;

wherein the return spring is a dome-shaped spring formed from an elastic material the actuator including a flow passage having a fluid outlet;

the stem including a flow passage having a fluid inlet;

the pump body formed as a hollow, cylindrical body, having an upper end, a fluid inlet at a lower end, and a pump chamber therebetween;

the upper check valve configured to control the flow of fluid through the fluid inlet of the stem;

the lower check valve configured to control the flow of fluid through the fluid inlet of the pump body;

wherein the actuator, stem and pump piston are interconnected and the pump piston reciprocates within the pump chamber upon down-strokes and upstrokes of the actuator;

wherein, the flow passage of the actuator is in fluid communication with the flow passage of the stem, which is in fluid communication with the pump chamber, which is in fluid communication with the container;

wherein the upper check valve comprises the stem, pump piston and a fluid inlet port formed in the stem, wherein the pump piston is configured to slide upwardly about the stem a distance sufficient to open the fluid inlet port upon down-strokes of the actuator and to slide downwardly about the stem a distance sufficient to close the fluid inlet port on upstrokes of the actuator;

wherein the lower check valve is a diaphragm configured to close the fluid inlet of the pump body on down-strokes of the actuator and open the fluid inlet upon upstrokes of the actuator;

wherein upon a down-stroke of the actuator, the upper check valve opens and the lower check valve closes;

wherein upon an upstroke of the actuator, the upper check valve closes and the lower check valve opens;

wherein the moving piston moves upwardly upon upstrokes of the actuator;

wherein the diaphragm comprises a dome-shaped sealing element suspended within a ring by a plurality of elastic elements, the ring including a plurality of semicircular stiffening elements spaced about and connected to an interior perimeter of the ring, the dome-shaped sealing element including a plurality of semicircular stiffening elements spaced about and connected to an exterior perimeter of the dome-shaped sealing element; and wherein each of the plurality of elastic elements interconnect a semicircular stiffening element of the ring and a semicircular stiffening element of the dome-shaped sealing element.

2. The hand operated airless dispensing pump made from all plastic materials, for dispensing fluid from a container of claim 1, wherein the actuator includes at least one vent in fluid (air) communication with at least one vent passage in the stem for venting a volume enclosed by the dome-shaped return spring.

3. The hand operated airless dispensing pump made from all plastic materials, for dispensing fluid from a container of claim 1, including at least one vent in the container for venting a volume of the container below the level of the moving piston.

4. The hand operated airless dispensing pump made from all plastic materials, for dispensing fluid from a container of claim 1, wherein the lower check valve comprises a ball.

5. A hand operated airless dispensing pump made from all plastic materials, for dispensing fluid from a container, comprising:

an actuator, a stem, a pump piston, a pump body, an upper check valve, a lower check valve, a return spring, a container and a moving piston;

the actuator including a flow passage having a fluid outlet;

the stem including a flow passage having a fluid inlet;

the pump body formed as a hollow, cylindrical body, having an upper end, a fluid inlet at a lower end, and a pump chamber therebetween;

the upper check valve configured to control the flow of fluid through the fluid inlet of the stem;

the lower check valve configured to control the flow of fluid through the fluid inlet of the pump body;

wherein the actuator, stem and pump piston are interconnected and the pump piston reciprocates within the pump chamber upon down-strokes and upstrokes of the actuator;

wherein, the flow passage of the actuator is in fluid communication with the flow passage of the stem, which is in fluid communication with the pump chamber, which is in fluid communication with the container;

wherein upon a down-stroke of the actuator, the upper check valve opens and the lower check valve closes; and wherein upon an upstroke of the actuator, the upper check valve closes and the lower check valve opens;

wherein the moving piston moves upwardly upon upstrokes of the actuator;

wherein the lower check valve is a diaphragm comprising a dome-shaped sealing element suspended within a ring by a plurality of elastic elements; and wherein the dome-shaped sealing element includes a plurality of semicircular stiffening elements spaced about and connected to an exterior perimeter of the sealing element.

6. The hand operated airless dispensing pump made from all plastic materials, for dispensing fluid from a container of claim 5, wherein the upper check valve comprises the stem, pump piston and a fluid inlet port formed in the stem, wherein the piston is configured to slide upwardly about the stem a distance sufficient to open the fluid inlet port upon down-strokes of the actuator and to slide downwardly about the stem a distance sufficient to close the fluid inlet port on upstrokes of the actuator.

7. The hand operated airless dispensing pump made from all plastic materials, for dispensing fluid from a container of claim 5, wherein the ring includes a plurality of semicircular stiffening elements spaced about and connected to an interior perimeter of the ring.

8. The hand operated airless dispensing pump made from all plastic materials, for dispensing fluid from a container of claim 5, wherein the dome-shaped sealing element is suspended within a ring by a plurality of elastic elements and wherein each of the plurality of elastic elements interconnect a stiffening element of the ring and a stiffening element of the dome-shaped sealing element.

9. The hand operated airless dispensing ump made from all plastic materials, for dispensing fluid from a container of claim 5, wherein the return spring is a dome-shaped spring formed from an elastic material.

10. The hand operated airless dispensing pump made from all plastic materials, for dispensing fluid from a container of claim 9, wherein the actuator includes at least one vent in fluid (air) communication with at least one vent passage in the stem for venting a volume enclosed by the dome-shaped return spring.

11. The hand operated airless dispensing pump made from all plastic materials, for dispensing fluid from a container of claim 5, including at least one vent in the container for venting a volume of the container below the level of the moving piston.

12. The hand operated airless dispensing pump made from all plastic materials, for dispensing fluid from a container of claim 5, wherein the lower check valve comprises a ball.

13. The hand operated airless dispensing pump made from all plastic materials, for dispensing fluid from a container of claim 9, wherein the wall thickness of the dome-shaped spring continuously tapers from a lower end of the spring to an upper end of the spring.

* * * * *